US010030571B2

(12) United States Patent
Yi

(10) Patent No.: US 10,030,571 B2
(45) Date of Patent: Jul. 24, 2018

(54) ENGINE HAVING WATER JACKET

(71) Applicants: Hyundai Motor Company, Seoul (KR); Kia Motors Corporation, Seoul (KR)

(72) Inventor: Jeawoong Yi, Uiwang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/334,498

(22) Filed: Oct. 26, 2016

(65) Prior Publication Data

US 2017/0268405 A1 Sep. 21, 2017

(30) Foreign Application Priority Data

Mar. 16, 2016 (KR) ..... 10-2016-0031656

(51) Int. Cl.
*F01P 3/02* (2006.01)
*F01P 7/14* (2006.01)
(Continued)

(52) U.S. Cl.
CPC ..... *F01P 3/02* (2013.01); *F01P 5/10* (2013.01); *F01P 7/14* (2013.01); *F02F 1/004* (2013.01);
(Continued)

(58) Field of Classification Search
CPC .. F01P 3/02; F01P 2003/021; F01P 2003/024; F01P 2003/027;
(Continued)

(56) References Cited

U.S. PATENT DOCUMENTS 6,481,392 B1 11/2002 Etemad
2005/0235930 A1* 10/2005 Xin ..... F02F 1/108 123/41.74
(Continued)

FOREIGN PATENT DOCUMENTS

DE 2727124 A1 12/1978
DE 196 40 122 C1 1/1998
(Continued)

OTHER PUBLICATIONS

European Search Report for European Patent Application No. 16195728.7 dated May 22, 2017, 8 pages.

*Primary Examiner* — Jacob Amick
(74) *Attorney, Agent, or Firm* — Morgan, Lewis & Bockius LLP

(57) ABSTRACT

An engine having a water jacket may include a cylinder block in which cylinder liners forming a combustion chamber may be disposed from a first end to a second end of the cylinder block, and a block water jacket may be formed around the cylinder liners, a cylinder head having a head water jacket coupled to a top of the cylinder block, receiving cooling water from an exhaust side of the block water jacket and discharging cooling water to an intake side of the block water jacket, and inserts that may be inserted into the block water jacket and that may have horizontal dividing blades dividing the block water jacket into upper and lower parts, legs extending downward from the horizontal dividing blades, and flow preventing protrusions protruding upward from the horizontal dividing blades to divide the upper part of the block water jacket.

13 Claims, 3 Drawing Sheets

(51) Int. Cl.

| | |
|---|---|
| ***F01P 5/10*** | (2006.01) |
| ***F02F 1/00*** | (2006.01) |
| ***F02F 1/14*** | (2006.01) |
| ***F02F 1/40*** | (2006.01) |
| *F02F 1/16* | (2006.01) |

(52) U.S. Cl.
CPC ..... *F02F 1/14* (2013.01); *F02F 1/40* (2013.01); *F01P 2003/021* (2013.01); *F01P 2003/024* (2013.01); *F01P 2003/027* (2013.01); *F01P 2003/028* (2013.01); *F01P 2007/146* (2013.01); *F01P 2060/04* (2013.01); *F01P 2060/16* (2013.01); *F02F 1/16* (2013.01)

(58) Field of Classification Search
CPC ..... F01P 2003/028; F01P 5/10; F01P 7/14; F02F 1/14; F02F 1/004; F02F 1/40
See application file for complete search history.

(56) References Cited

U.S. PATENT DOCUMENTS

| | | | | |
|---|---|---|---|---|
| 2013/0032117 | A1* | 2/2013 | Worthington ..... | F02F 1/004 123/193.2 |
| 2015/0159540 | A1 | 6/2015 | Misumi et al. | |
| 2015/0345363 | A1* | 12/2015 | Marutani ..... | F01P 3/02 123/41.44 |
| 2016/0010533 | A1* | 1/2016 | Matsumoto ..... | F01P 3/02 123/41.08 |
| 2017/0067411 | A1* | 3/2017 | Doho ..... | F02F 1/004 |

FOREIGN PATENT DOCUMENTS

| | | | |
|---|---|---|---|
| EP | 1930564 | A1 | 6/2008 |
| JP | 2005-315118 | A | 11/2005 |
| JP | 2011-106398 | A | 6/2011 |
| JP | 5146024 | B2 | 2/2013 |
| JP | 2014-163224 | A | 9/2014 |
| JP | 2015-071969 | A | 4/2015 |
| KR | 10-2009-0040091 | A | 4/2009 |
| KR | 10-2009-0063995 | A | 6/2009 |
| KR | 10-2009-0102191 | A | 9/2009 |
| WO | WO 2008/010584 | A1 | 1/2008 |

* cited by examiner (Section II-II)

ENGINE HAVING WATER JACKET

CROSS-REFERENCE TO RELATED APPLICATION

The present application claims priority to Korean Patent Application No. 10-2016-0031656, filed Mar. 16, 2016, the entire contents of which is incorporated herein for all purposes by this reference.

BACKGROUND OF THE INVENTION

Field of the Invention

The present invention relates to an internal combustion engine, and more particularly, to an engine having a water jacket in which a block water jacket is divided into upper and lower parts and cooling water flowing through the upper part of the block water jacket flows from the exhaust side of a head water jacket to the intake side to form a cross-flow.

Description of Related Art

In general, water-cooled engines are cooled by pumping cooling water from a water pump to a water jacket inside a cylinder block and a water jacket inside a cylinder head.

Since the water pump is installed on the cylinder block, cooling water pumped from the water pump is fed first to the water jacket inside the cylinder block and then guided to the water jacket inside the cylinder head.

The cylinder head gets hot easily because it forms a combustion chamber—especially, around an exhaust port due to the circulation of combustion gases. In this regard, cooling water passages from the water jacket in the cylinder block are installed around the exhaust port in the cylinder head, in order to improve the cooling performance around the exhaust port.

Recently, there has been introduced a structure that improves the cooling efficiency of cooling water by separating the water jackets in the cylinder head and cylinder block into a head water jacket and a block water jacket and controlling cooling water fed to the head and block water jackets, and that reduces fuel consumption by individually controlling the temperatures in them.

There was introduced another structure that actively cools a high-temperature part in the exhaust port (exhaust side) using a cross-flow design that allows cooling water flowing through the head water jacket in the cylinder head to flow from the exhaust side to the intake side, and that reduces fuel consumption and improves cooling efficiency by blocking the flow of cooling water to the block water jacket in the cylinder block in a low-temperature condition.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine having a water jacket which improves cooling efficiency by dividing a block water jacket into upper and lower parts and allowing cooling water flowing through the upper part of the block water jacket to flow from the exhaust side of a head water jacket to the intake side and form a cross-flow.

According to various aspects of the present invention, an engine having a water jacket may include a cylinder block in which cylinder liners forming a combustion chamber may be disposed from a first end to a second end of the cylinder block, and a block water jacket may be formed around the cylinder liners, a cylinder head having a head water jacket coupled to a top of the cylinder block, receiving cooling water from an exhaust side of the block water jacket through a first connecting passage, and discharging cooling water to an intake side of the block water jacket, and inserts that may be inserted into the block water jacket and that may have horizontal dividing blades dividing the block water jacket into upper and lower parts, legs extending downward from the horizontal dividing blades, and flow preventing protrusions protruding upward from the horizontal dividing blades to divide the upper part of the block water jacket into an upper exhaust part and an upper intake part.

The engine may further include a water pump coupled to the cylinder block to pump cooling water to one end of the lower part of the exhaust side of the block water jacket under the horizontal dividing blades, in which a top opening portion that connects to the upper and lower parts may be formed on the exhaust side of the horizontal dividing blade.

The cooling water may be pumped by the water pump and fed to the one end of the lower part of the exhaust side of the block water jacket may be fed to the upper part of the exhaust side of the block water jacket.

The cooling water fed to the upper part of the exhaust side of the block water jacket may flow from the exhaust side of the head water jacket to the intake side through the first connecting passage and may be circulated to the upper part of the intake side of the block water jacket through the second connecting passage.

The engine may further include a water control valve placed on the second end of the cylinder block, in which the water control valve may control cooling water flowing through the lower part of the block water jacket corresponding to the legs and discharged from the block water jacket, and may control cooling water sequentially flowing through and discharged from the upper part of the exhaust side of the block water jacket, the first connecting passage, the head water jacket, the second connecting passage, and the upper part of the intake side of the block water jacket.

The legs may be placed at a center of the lower part of the block water jacket so as to divide the lower part of the block water jacket into an outside part and an inside part.

The leg of the exhaust insert may include a side opening portion that connects the outside and inside of the lower part of the block water jacket.

The side opening portion and the top opening portion may be connected together and integrated into a single unit.

The inserts may include an exhaust insert formed on the exhaust side and an intake insert formed on the intake side and facing the exhaust insert.

The top opening portion may be formed on a first end of the exhaust insert.

The flow preventing protrusions may be formed on first and second ends of the intake insert.

A vertical transfer passage may be formed in the gap between a second end of the exhaust insert and the second end of the intake insert, and cooling water fed to the lower part of the exhaust side of the block water jacket may move along the legs and then move up through the vertical transfer passage and may be circulated to the water control valve.

Guide protrusions extending upward may be formed at corresponding positions between the cylinder liners on the exhaust insert and intake side.

The guide protrusions may be disposed at a distance from the cylinder liners so that the cooling water flowing through the upper part of the block water jacket flows in between the cylinder liners.

According to various embodiments of the present invention, it is possible to form a cross-flow from the exhaust side of the head water jacket to the intake side without the use of an extra water jacket since the block water jacket is divided into upper and lower parts by inserts that are inserted into the block water jacket, the cooling water flowing through the lower part of the exhaust side of the block water jacket cools the lower part of the cylinder block, and the cooling water flowing through the upper part of the exhaust side of the block water jacket flows from the exhaust side of the head water jacket to the intake side.

Moreover, the temperature in the upper part of the block water jacket can be reduced as the cooling water flowing through the upper part of the block water jacket in the cylinder block is fed to the head water jacket. This may result in increase in knocking characteristics and improvement in performance and fuel efficiency.

Further, there is no need to include water chambers for cooling the block water jacket and the head water jacket separately, and this may lead to decrease in weight and improvement in fuel efficiency.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
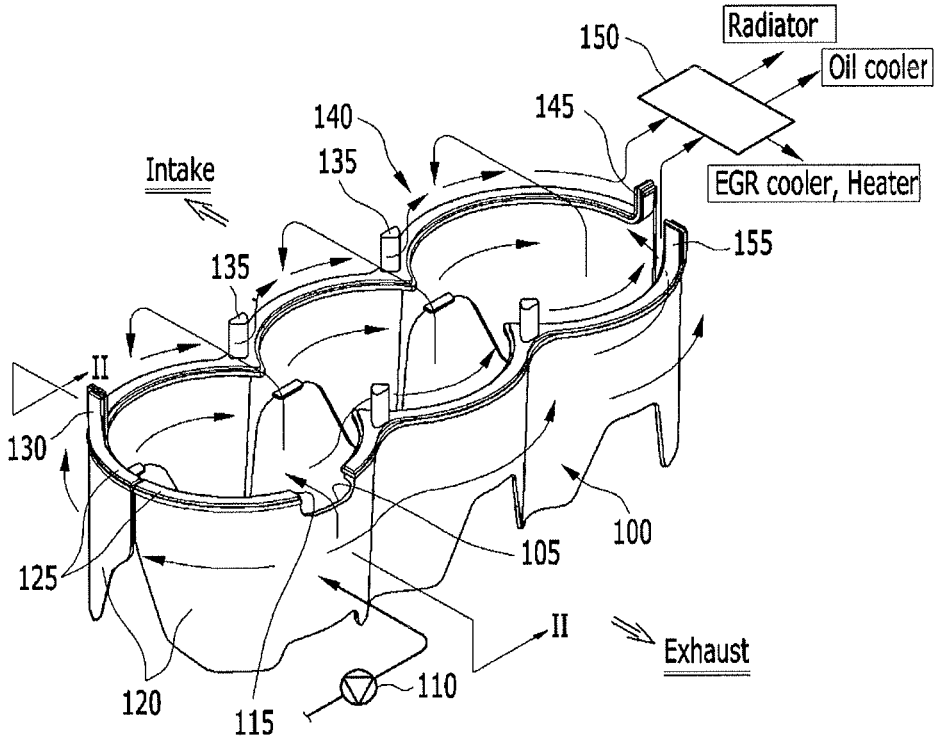
FIG. 1 is a perspective view of inserts placed in a water jacket in a cylinder block of an engine according to various embodiments of the present invention.
Figure 2:
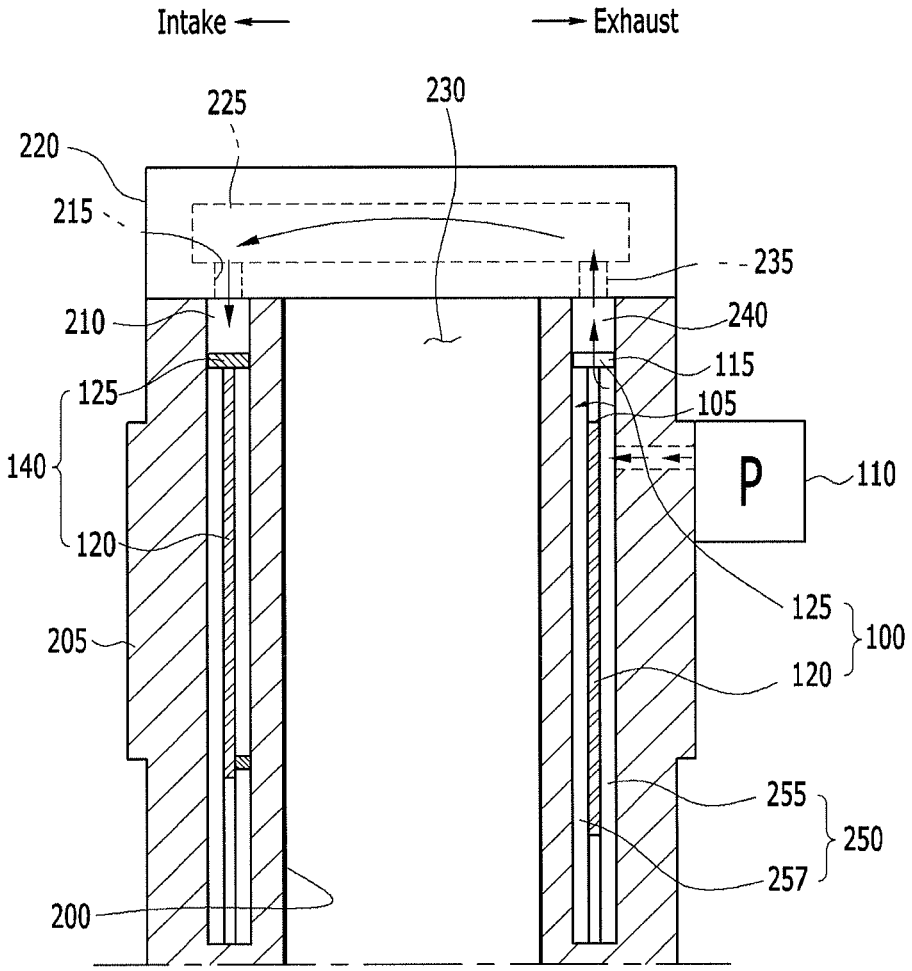
FIG. 2 is a schematic cross-sectional view showing a vertical cross-section of an engine having a water jacket according to various embodiments of the present invention.
Figure 3:
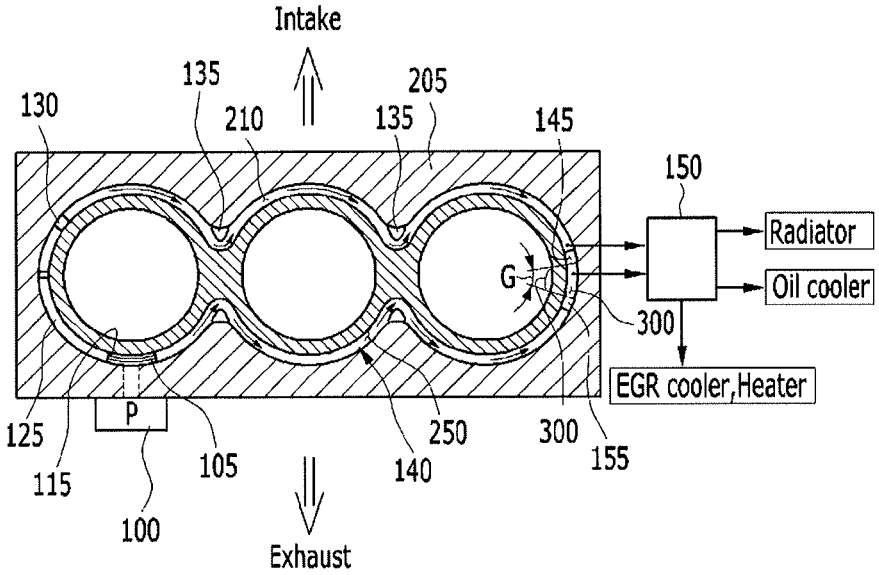
FIG. 3 is a schematic cross-sectional view showing a horizontal cross-section of an engine having a water jacket according to various embodiments of the present invention.

Cylinder liners where pistons are seated are arranged at predetermined intervals from one end to the other end of a cylinder block, and a block water jacket is formed around the cylinder liners, as illustrated in FIGS. 1, 2, and 3.

Inserts 100 and 140 according to various embodiments of the present invention are inserted into the above-mentioned block water jacket 250, and the block water jacket 250 is divided into upper and lower parts to control the flow of cooling water. For more details about this structure, refer to FIG. 1.

FIG. 1 is a perspective view of inserts placed in a water jacket in a cylinder block of an engine according to various embodiments of the present invention.

Referring to FIG. 1, the inserts 100 and 140 are inserted into a block water jacket 250 in a cylinder block 205, and the inserts 100 and 140 include an exhaust insert 100 to be inserted into the exhaust side and an intake insert 140 to be inserted into the intake side.

Horizontal dividing blades 125 dividing the block water jacket 250 into upper and lower parts are formed on the top edges of the exhaust insert 100 and intake insert 140, and legs 120 extend downward from the horizontal dividing blades 125.

A top opening portion 115 that connects to the upper and lower parts is formed in the horizontal dividing blade 125 of the exhaust insert 100, and a side opening portion 105 that is open along the side is formed in the leg 120 of the exhaust insert 100. The top opening portion and the side opening portion may be connected together and integrated into a single unit.

A water pump 110 is placed on the side of one end of the exhaust side of the cylinder block 205 to pump cooling water to the outside of the legs 120, and the pumped cooling water is fed to the inside of the legs 120 through the side opening portion 105.

Accordingly, the cooling water cools the lower part of the cylinder block 205 as it flows from one end of the lower part of the block water jacket 250 to the other end along the outer and inner surfaces of the legs 120.

Moreover, part of the cooling water pumped to the outer surface of one end of the legs 120 moves up from the horizontal dividing blades 125 through the top opening portion 115.

The cooling water that has moved up from the horizontal dividing blades 125 cools the upper part of the exhaust side of the cylinder block 205 as it flows through the upper part of the block water jacket 250, and is then circulated to a head water jacket 225 in a cylinder head 220 bolted to the top of the cylinder block 205.

More specifically, a third flow preventing protrusion 155 protrudes upward from the other end of the horizontal dividing blade 125 of the exhaust insert 100, and a first flow preventing protrusion 130 and a second flow preventing protrusion 145 protrude upward from one end and the other end of the horizontal dividing blade 125, respectively, of the intake insert 140.

Cooling water that has entered the upper exhaust part 240 of the block water jacket 250 cools the upper part of the exhaust side of the cylinder block 205 as it flows toward the first flow preventing protrusion 130 and the third flow preventing protrusion 155.

Then, because of the first flow preventing protrusion 130 and the third flow preventing protrusion 155, the cooling water is fed to the exhaust side of the head water jacket 225 in the cylinder head 220 placed on top of them.

Here, the cooling water fed to the exhaust side of the head water jacket 225 in the cylinder head 220 flows from the exhaust side of the head water jacket 225 to the intake side, thereby forming a cross-flow.

In various embodiments of the present invention, the cooling water that has flowed from the exhaust side of the head water jacket 225 to the intake side descends to the upper intake part 210 of the block water jacket 250 through a second connecting passage 215 (see FIG. 2).

Next, the cooling water that has descended to the upper intake part 210 of the block water jacket 250 flows from one end to the other end and reaches the second flow preventing protrusion 145, and then flows up along the second flow preventing protrusion 145 and reaches a water control valve 150.

The cooling water in the block that flows through the inside and outside of the legs 120 of the exhaust insert 100 and intake insert 140 moves up through a vertical transfer passage 300 (see FIG. 2) between the second flow prevention protrusion 145 and the third flow prevention protrusion 155 and reaches the water control valve 150.

Referring again to FIG. 1, guide protrusions 135 at predetermined positions on the horizontal dividing blades 125 extend upward a predetermined distance. The guide protrusions 135 are placed between cylinder liners 200. In other words, the guide protrusions 135 are formed on the outside part of the top of the horizontal dividing blades 125 so that cooling water flows to recessed portions of the cylinder liners 200.

FIG. 2 is a schematic cross-sectional view showing a vertical cross-section of an engine having a water jacket according to various embodiments of the present invention.

Referring to FIG. 2, an engine includes a cylinder block 205, a cylinder head 220, a water control valve 150, and inserts 100 and 140, and the inserts 100 and 140 include legs 120 and horizontal dividing blades 125.

The cylinder block 205 has a block water jacket 250 around the cylinder liners 200, and the cylinder head 220 has a head water jacket 225 along the exhaust and intake sides.

Moreover, a first connecting passage 235 connects the exhaust side of the head water jacket 225 and the upper exhaust part 240 of the block water jacket 250, and a second connecting passage 215 connects the intake side of the head water jacket 225 and the upper intake part 210 of the block water jacket 250.

The block water jacket 250 is divided into an outside part 255 and an inside part 257 relative to the legs 120 of the inserts 100 and 140, and cooling water pumped by the water pump 110 is fed to the outside part 255 of the exhaust side of the block water jacket 250.

The cooling water fed to the outside part 255 of the exhaust side of the block water jacket 250 is fed to the inside part 257 of the block water jacket 250 through the side opening portion 105 in the leg 120 of the exhaust insert 100, and cools the entire lower part of the block water jacket 250 that corresponds to the legs 120.

Moreover, the cooling water fed to the outside part 255 of the exhaust side of the block water jacket 250 is circulated to the upper exhaust part 240 of the block water jacket 250, the first connecting passage 235, the exhaust side of the head water jacket 225, and the intake side of the head water jacket 225 through the top opening portion 115 formed in the horizontal dividing blade 125 of the exhaust insert 100, and then to the upper intake part 210 of the block water jacket 250 through the second connecting passage 215.

According to various embodiments of the present invention, the block water jacket 250 is divided into upper and lower parts by the horizontal dividing blades 125 of the inserts 100 and 140, and the upper part of the block water jacket 250 corresponds to a combustion chamber and the lower part of the block water jacket 250 corresponds to the legs 120.

FIG. 3 is a schematic cross-sectional view showing a horizontal cross-section of an engine having a water jacket according to various embodiments of the present invention.

Referring to FIG. 3, cooling water pumped by the water pump 110 circulates through the lower part of the block water jacket 250 that corresponds to the legs 120, and part of the cooling water moves to the upper exhaust part 240 of the block water jacket 250 through the top opening portion 115.

The cooling water that has moved to the upper exhaust part 240 of the block water jacket 250 is kept from moving to the upper intake part of the block water jacket 250 due to the first flow preventing protrusion 130 formed on one end of the intake insert 140 and the third flow preventing protrusion 155 formed on the other end of the exhaust insert 100, but is circulated to the exhaust side of the head water jacket 225 through the first connecting passage 235.

The cooling water circulated to the exhaust side of the head water jacket 225 flows to the intake side of the head water jacket 225, and then flows to the upper intake part 210 of the block water jacket 250 through the second connecting passage 215.

Next, the cooling water in the upper intake part 210 of the block water jacket 250 moves toward the second flow preventing protrusion 145.

The cooling water that has moved to the second flow preventing protrusion 145 is guided by the second flow preventing protrusion 145 and circulated to the water control valve 150.

Moreover, the cooling water circulating through the lower parts of the exhaust and intake sides of the block water jacket 250 moves up through the vertical transfer passage 300 formed by the gap G between the second flow preventing protrusion 145 and the third flow preventing protrusion 155, and is then circulated to the water control valve 150.

The water control valve 150 receives the cooling water that has passed through the lower part of the block water jacket 250 and the upper part of the block water jacket 250, and distributes it to a radiator, oil cooler, EGR cooler, and heater.

In various embodiments, the water control valve 150 is a motor-driven type which controls the cooling water distributed to the radiator, oil cooler, EGR cooler, and heater according to an operating condition.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine having a water jacket, the engine comprising:

a cylinder block in which cylinder liners forming a combustion chamber are disposed from a first end to a second end of the cylinder block, and a block water jacket is formed around the cylinder liners;

a cylinder head having a head water jacket coupled to a top of the cylinder block, receiving cooling water from an exhaust side of the block water jacket through a first connecting passage, and discharging cooling water to an intake side of the block water jacket through a second connecting passage; and inserts that are inserted into the block water jacket and that have horizontal dividing blades dividing the block water jacket into upper and lower parts, legs extending downward from the horizontal dividing blades, and first, second and third flow preventing protrusions respectively protruding upward from the horizontal dividing blades to divide the upper part of the block water jacket into an upper exhaust part and an upper intake part, wherein the first flow preventing protrusion is formed at a first end of the upper intake part of the block water jacket, the second flow preventing protrusion is formed at a second end of the upper intake part of the block water jacket, and the third flow preventing protrusion is formed at a second end of the upper exhaust part of the block water jacket, and wherein cooling water is supplied to the upper part of the block water jacket through a first end of the upper exhaust part.

2. The engine of claim 1, further comprising a water pump coupled to the cylinder block to pump the cooling water to a first end of the lower part of the exhaust side of the block water jacket under the horizontal dividing blades, wherein a top opening portion that connects to the upper and lower parts is formed on the exhaust side of the horizontal dividing blade.

3. The engine of claim 2, wherein the cooling water pumped by the water pump and fed to the first end of the lower part of the exhaust side of the block water jacket is fed to the upper part of the exhaust side of the block water jacket.

4. The engine of claim 3, wherein the cooling water fed to the upper part of the exhaust side of the block water jacket flows from the exhaust side of the head water jacket to the intake side through the first connecting passage and is circulated to the upper part of the intake side of the block water jacket through the second connecting passage.

5. The engine of claim 4, further comprising a water control valve placed on the second end of the cylinder block, wherein the water control valve controls cooling water flowing through the lower part of the block water jacket corresponding to the legs and discharged from the block water jacket, and controls cooling water sequentially flowing through and discharged from the upper part of the exhaust side of the block water jacket, the first connecting passage, the head water jacket, the second connecting passage, and the upper part of the intake side of the block water jacket.

6. The engine of claim 3, wherein the legs are placed at a center of the lower part of the block water jacket to divide the lower part of the block water jacket into an outside part and an inside part.

7. The engine of claim 6, wherein the leg of the exhaust insert includes a side opening portion that connects the outside and inside of the lower part of the block water jacket.

8. The engine of claim 7, wherein the side opening portion and the top opening portion are connected together and integrated into a single unit.

9. The engine of claim 5, wherein the inserts comprise an exhaust insert formed on the exhaust side and an intake insert formed on the intake side and facing the exhaust insert.

10. The engine of claim 9, wherein the top opening portion is formed on a first end of the exhaust insert.

11. The engine of claim 10, wherein a vertical transfer passage is formed in the gap between a second end of the exhaust insert and the second end of the intake insert; and cooling water fed to the lower part of the exhaust side of the block water jacket moves along the legs and then moves up through the vertical transfer passage and is circulated to the water control valve.

12. The engine of claim 9, wherein guide protrusions extending upward are formed at corresponding positions between the cylinder liners on the exhaust insert and intake side.

13. The engine of claim 12, wherein the guide protrusions are disposed at a distance from the cylinder liners so that the cooling water flowing through the upper part of the block water jacket flows in between the cylinder liners.

* * * * *